US005235938A

United States Patent [19]

Haussmann et al.

[11] Patent Number: 5,235,938

[45] Date of Patent: Aug. 17, 1993

[54] INTERNAL COMBUSTION ENGINE HAVING AN INDUCTION CONDUIT FOR THE INDUCTION OF FRESH AIR

[75] Inventors: Gerhard Haussmann, Leinfelden; Achim Guggenmos, Plochingen; Heiko Gensert, Waiblingen; Rolf Zeller, Burgstetten; Helmut Seitz, Stuttgart; Klaus Kofahl, Weinstadt; Joachim Minich, Winnenden, all of Fed. Rep. of Germany

[73] Assignee: Mercedes-Benz AG, Fed. Rep. of Germany

[21] Appl. No.: 889,266

[22] Filed: May 28, 1992

[30] Foreign Application Priority Data

Jun. 6, 1991 [DE] Fed. Rep. of Germany ..... 4118557

[51] Int. Cl.[5] ..... F02M 35/10

[52] U.S. Cl. ..... 123/52 M; 123/572

[58] Field of Search ..... 123/572, 52 M, 52 MV, 123/52 MB, 52 MC

[56] References Cited

U.S. PATENT DOCUMENTS

| | | | |
|---|---|---|---|
| 4,354,458 | 10/1982 | Bury | 123/52 M |
| 4,597,372 | 7/1986 | Furukawa | 123/572 |
| 4,607,604 | 8/1986 | Kanoh et al. | 123/572 |
| 4,721,090 | 1/1988 | Kato | 123/572 |
| 4,875,438 | 10/1989 | Suzuki et al. | 123/572 |
| 4,993,375 | 2/1991 | Akihiko | 123/572 |

FOREIGN PATENT DOCUMENTS

| | | | |
|---|---|---|---|
| 0448431 | 9/1991 | European Pat. Off. . | |
| 1223620 | 8/1966 | Fed. Rep. of Germany . | |
| 2702160 | 7/1978 | Fed. Rep. of Germany . | |
| 3326881 | 5/1984 | Fed. Rep. of Germany . | |
| 3217633 | 9/1984 | Fed. Rep. of Germany . | |
| 3509439 | 3/1988 | Fed. Rep. of Germany . | |
| 3414710 | 5/1988 | Fed. Rep. of Germany . | |
| 8900612 | 5/1989 | Fed. Rep. of Germany . | |
| 3821528 | 9/1989 | Fed. Rep. of Germany . | |
| 4000060 | 2/1991 | Fed. Rep. of Germany . | |
| 3713210 | 8/1991 | Fed. Rep. of Germany . | |
| 46-23977 | 7/1971 | Japan | 123/572 |
| 0151149 | 11/1980 | Japan | 123/572 |
| 0032021 | 4/1981 | Japan | 123/572 |
| 61276 | 5/1983 | Japan | 123/572 |
| 0206609 | 11/1984 | Japan | 123/572 |
| 0033417 | 2/1991 | Japan | 123/572 |

*Primary Examiner*—David A. Okonsky

*Attorney, Agent, or Firm*—Evenson, McKeown, Edwards & Lenahan

[57] ABSTRACT

An internal combustion engine has an induction conduit for the induction of fresh air. A section of the induction conduit extends over the cylinder head cover. In order to achieve the simplest and most operationally reliable engine space ventilation possible, the induction conduit section is provided with at least one connection stub pipe which protrudes through an opening provided in the cylinder head cover into a camshaft space. The camshaft space is connected to the induction conduit in an advantageously simple manner.

7 Claims, 2 Drawing Sheets

INTERNAL COMBUSTION ENGINE HAVING AN INDUCTION CONDUIT FOR THE INDUCTION OF FRESH AIR

BACKGROUND AND SUMMARY OF THE INVENTION

The present invention concerns an internal combustion engine having an induction conduit of for the induction of fresh air, and more particularly, an engine in which a cylinder head cover covers a camshaft space of the internal combustion engine at the top portion, with a section of the induction conduit extending over the cylinder head cover.

An internal combustion engine is shown in DE-PS 32 17 633. In addition, engine space ventilation is known for an internal combustion engine associated with an exhaust gas turbocharger as shown in DE-GM 89 00 612. The ventilation described therein takes place via ducts located within the engine casing and by a conduit external to the engine.

An object of the present invention is to provide internal combustion engine space ventilation, which is as simple as possible and is as operationally reliable as possible.

That object has been achieved according to the present invention by providing that the induction conduit section has at least one connection stub pipe protruding through an opening in the cylinder head cover into the camshaft space. The connection between the camshaft space and the induction conduit therefore takes place without a special conduit so that, on one hand, simple engine space ventilation is achieved because of the small number of parts and because of the short paths involved. On the other hand, the operational reliability of the invention is ensured because the hot ventilation gases are only subject to a small amount of cooling on the short path from the engine space to the induction conduit so that freezing of the connection is avoided. Because the engine space ventilation is necessarily connected during the fitting of the induction conduit, fitting is also simplified.

In one embodiment of the invention, a ring-shaped sealing element is pressed into each opening of the cylinder head cover in order to seal the camshaft space from the space external to the engine. The sealing element is in contact with the outside of the connection stub pipe by a sealing lip. During assembly, the connection stub pipe is pushed in a simple manner through the sealing element provided in the opening. The sealing element is then in sealing contact with the connection stub pipe so that no additional connecting elements, such as hose clips, are necessary for sealing.

A further advantageous feature of the present invention is that the cylinder head cover has at least one raised section which encloses a ventilation space separated from the camshaft space by a precipitation plate, with the connection stub pipe being connected to the ventilation space. The provision of a precipitation plate in the cylinder head cover as a protecting plate substantially prevents the oil thrown up by a camshaft from reaching the connection stub pipe. A ventilation space is created through which ventilation gases flow almost exclusively and which is separated from the camshaft space by the precipitation plate. By suitable dimensioning of the ventilation space, oil penetrating with the ventilation gases can be precipitated on the walls of the ventilation space. The cross-section of the connection stub pipe is also increased such that the flow velocity of the ventilation gases is very low so that only a little oil is entrained into the induction conduit by the gases.

According to yet another advantageous aspect of the present invention, a lower wall section of the induction conduit is doubled to form a ventilation duct. The ventilation duct is connected via a gap to the induction conduit at the downstream end of the section. The ventilation gases are screened thereby from the suction effect of the static pressure, which is very low at full-load operation. This low static pressure occurs because of the high velocity of the fresh air flowing through the induction conduit. The ventilation duct therefore represents a substantially still zone in which the oil entrained in the ventilation gases is precipitated and can then flow back into the crankcase via the connection stub pipes. Further on in the flow direction, the ventilation gases pass via the gap at the end of the wall section into the induction conduit.

A still further advantage of the present invention resides in the fact that the lower wall section of the induction conduit is offset towards the center of the induction conduit in the region of the connection stub pipes. In addition, the connection stub pipes are accommodated in a cap which is located within the extent of the induction conduit and covers the lower wall section so that the wall section and the cap form the boundaries of the ventilation duct. The wall section offset towards the center of the induction conduit reduces the cross-sectional area of the induction conduit on one section so that pulsations, which can occur in the induction conduit at full-load operation because of the flow through the valves, are damped. This prevents the suction effect of the vacuum regions formed locally by pulsations from acting on the oil containing ventilation gases from the crankcase ventilation.

Advantageously, the gap at the downstream end of the section can also be located at a distance from the cap. Consequently, the end of the section forms an oil weir at which is substantially precipitated and collected the rest of the entrained oil from the ventilation gases and which restrains the separated oil from flowing out into the induction conduit. Overall, the hereinafter described currently contemplated embodiments of the present invention substantially prevent oil from the crankcase ventilation from entering the induction conduit so that the oil consumption is reduced. In addition, the formation of blue smoke and HC emissions is reduced during engine combustion so that, because of the decreased load on it, the life of a catalyzer provided in an exhaust gas system can be extended.

Finally, it is possible to prevent a hot-wire air meter located in the induction conduit from being subjected to oil thus avoiding the erroneous recognition of the air mass induced, due to the presence of oil.

BRIEF DESCRIPTION OF THE DRAWINGS

These and further objects, features and advantages of the present invention will become more readily apparent from the following detailed description of currently preferred embodiments using a section of an induction conduit of a fresh air induction system in an internal combustion engine having two connection stub pipes and having a camshaft space located under a cylinder head cover when taken in conjunction with the accompanying drawings wherein.

DETAILED DESCRIPTION OF THE DRAWINGS

Figure 1:
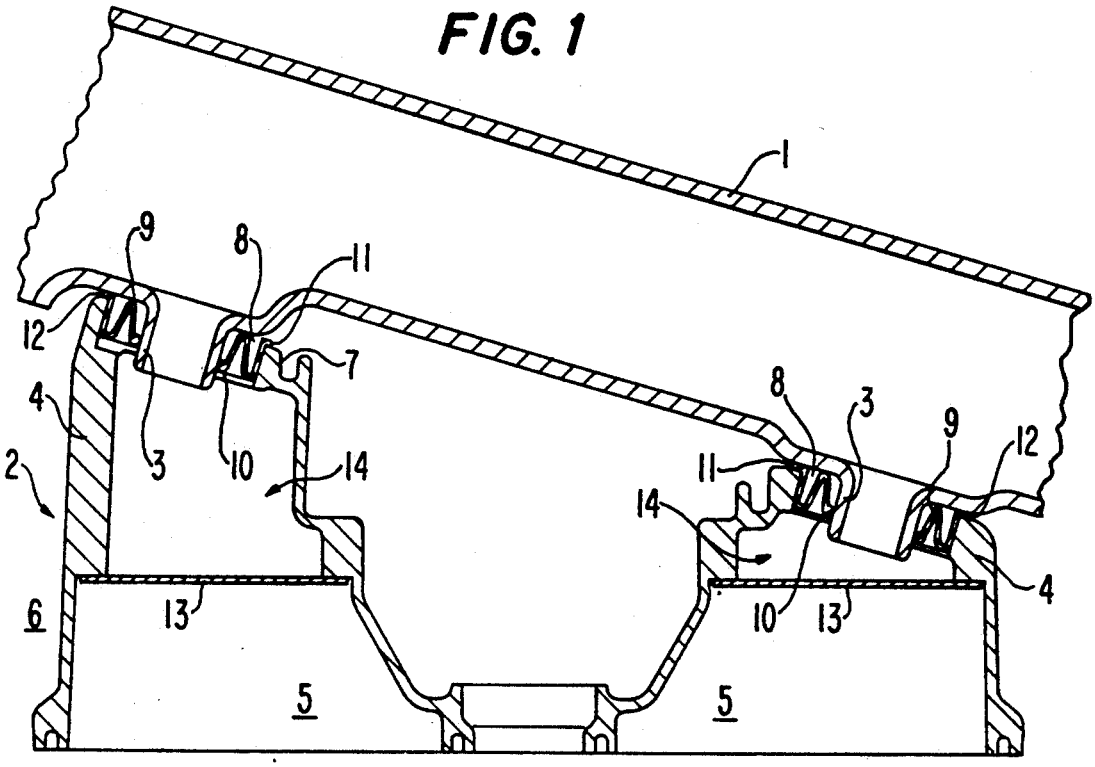
FIG. 1 is a sectional view of an induction conduit extending transversely over a cylinder head cover with connection stub pipes on a ventilation space.

In FIG. 1, a section 1 of an internal combustion engine induction conduit (shown only generally for clarity) passes over the cylinder head cover 2 of the internal combustion engine and transversely to the engine longitudinal axis. In its extent, not shown here in any more detail, the induction conduit 1 is connected with, for example, an air filter. Two spaced connection stub pipes 3 leading off to the cylinder head cover 2 are formed on the section 1. The cylinder head cover 2 has two raised cover sections 4 located opposite one another relative to the engine longitudinal axis and screens a camshaft space 5 from space 6 external to the engine. The raised cover sections 4 have openings 8 in a top 7 of the cylinder head cove 2 and the connection stub pipes 3 protrudes therethrough.

Ring-shaped bellow-like sealing elements 9 are pressed into the openings 8 in order to seal the space 6 external to the engine from the camshaft space 5. The sealing elements 9 are in contact with the connection stub pipes 3 so as to seal radially on them by way of sealing lips 10 formed on their inner edges. The sealing elements 9 also engage around the edges 12 of the openings 8 and seal axially by way of a flange 11 formed on the outer edges of the sealing elements 9. Large tolerances can be accommodated during assembly and compensation can be provided for running vibrations by the elastic configuration of the sealing elements 9. Two ventilation spaces 14, in which essentially the ventilation gases emerging from the engine space flow via the connection stub pipes 3 to the induction conduit 1, are separated from the camshaft space 5 by two precipitation plates 13 attached within the cylinder head cover 2 and covering the raised cover sections 4 towards the top.

Figure 2:
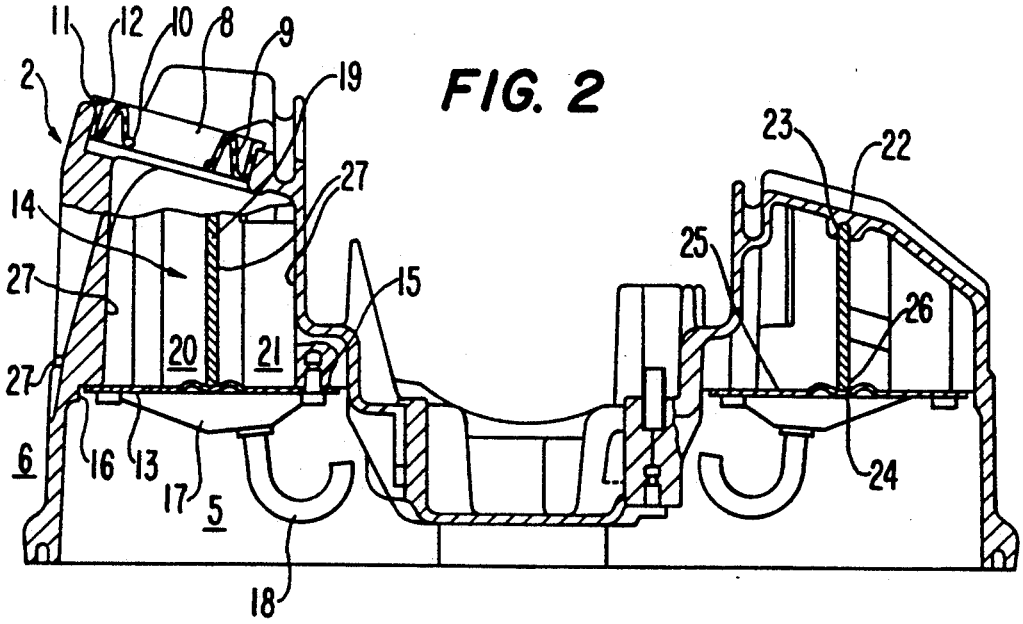
FIG. 2 is a cross-sectional view of the configuration of the ventilation space shown in FIG. 1.

As shown in FIG. 2, the precipitation plates 13 are connected by screws 15 to the inside 16 of the cylinder head cover 2 and have open channels (not shown) from the camshaft space 5 to the ventilation spaces 14. Each precipitation plate 13 has a catchment sump 17 from which a syphon-type conduit stub pipe 18 branches off to the camshaft space 5. The ventilation spaces 14 are each subdivided into two chambers 20, 21 by a partition 19 extending perpendicular to the precipitation plates 13, with the chambers 20 having access to the camshaft space 5. The top 22 of the partition 19 is held in a groove 23 located in a top region of the cylinder head cover 2, and the bottom 24 of the partition 19 is held in a further groove 26 located on an upper surface 25 of the precipitation plate 13. One of the long sides of the partition 19 terminates flush with the inside 16 of the cylinder head cover 2, whereas its other long side forms a gap with the inside 16. In its upper region, the chamber 21 has outlets (not shown) to the connection stub pipes 3.

By way of the channels (not shown), the ventilation gases pass from the engine space via the camshaft space 5 together with a small part of the oil, which is thrown by the rotating camshafts (not shown) located in the camshaft space 5, against the precipitation plates 13, into the chambers 20 of the ventilation spaces 14 and via the gaps into the chambers 21. The major proportion of the oil penetrating into the ventilation space 14 is precipitated by multiple deflection of the ventilation gases on the walls 27 of the chambers 20, 21, runs down into the catchment sump 17 and flows via the conduit stub pipe 18 back into the camshaft space 5. Because of the partition 19, the path of the ventilation gases mixed with oil flowing through the ventilation spaces 14 to the induction conduit is extended so that the precipitation rate of the oil in the chambers 20, 21 is increased.

Figure 3:
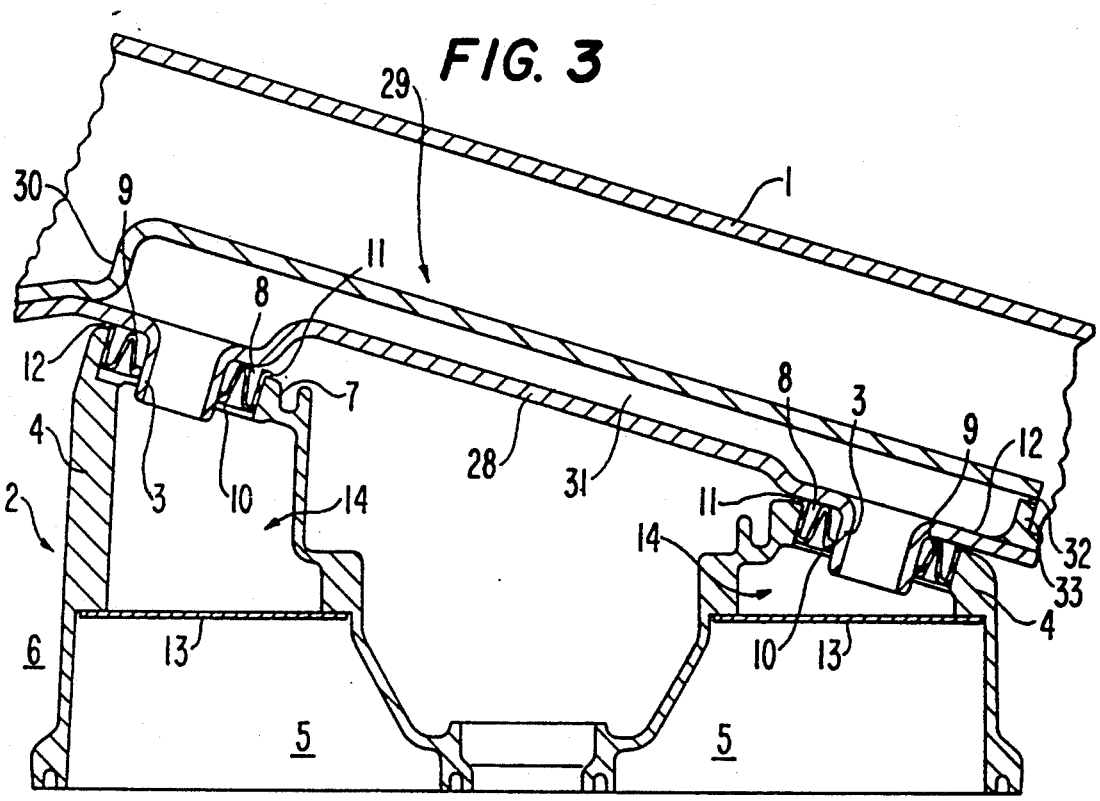
FIG. 3 is a sectional view of the induction conduit section of FIG. 1 but with a ventilation duct located on the induction conduit and connected to the ventilation space via the connection stub pipes.

In the alternative embodiment of FIG. 3, a cap 28 is fastened on the lower peripheral region of the induction conduit section 1. This cap extends along the induction conduit and accepts the two connection stub pipes 3 leading away to the cylinder head cover 2. In the region of the connection stub pipes 3, a lower wall section 29 of the induction conduit section 1 is offset towards the center of the induction conduit, forming a bent edge 30 at the inlet end. This lower wall section 29 is covered by the cap 28 and, together with the latter, forms a ventilation duct 31 which leads the ventilation gases away from the crankcase. The ventilation duct 31 is connected to the induction conduit by a gap 32 following on from the ventilation duct 31 in the downstream flow direction of the induction conduit. The gap 32 is therefore located at the end 33 of the section, at a distance from the cap 28, so that the gap 32 forms a narrow passage for the ventilation gases and the end 33 of the section forms an oil weir for the oil entrained in the ventilation gases.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. An internal combustion engine having an induction conduit common to cylinders of the engine for the induction of fresh air into the cylinders, comprising a cylinder head cover covering a camshaft space at a top portion of the internal combustion engine, a section of the common induction conduit extending over the cylinder head cover, wherein the induction conduit section has at least one connection stub pipe protruding in a straight line from a lower wall of the induction conduit section though an opening provided in the cylinder head cover into the camshaft space, a bellows-like sealing element is pressed into the opening so as to be operatively arranged between the cylinder head cover and the stub pipe and is provided with a radially displaceable sealing lip in contact with an outer portion of the stub pipe.

2. The internal combustion engine according to claim 1, wherein the connection stub pipe is formed on the induction conduit section.

3. The internal combustion engine according to claim 1, wherein the cylinder head cover has at least one raised section enclosing a ventilation space, a precipitation plate separating the ventilation space from the camshaft space, and the connection stub pipe is connected to the ventilation space.

4. The internal combustion engine according to claim 1, wherein a lower wall section of the induction conduit is configured to form a ventilation duct connected via a gap to the induction conduit at a downstream end of the section.

5. The internal combustion engine according to claim 4, wherein the lower wall section of the induction conduit is offset towards the center of the induction conduit in a region of the connection stub pipes, and a cap located within the extent of the induction conduit covers the lower wall section, the connection stub pipes being provided in the cap and the ventilation duct being bounded by the wall section and the cap.

6. The internal combustion engine according to claim 5, wherein the gap is located at a distance from the cap at the downstream end of the section.

7. The internal combustion engine according to claim 6, wherein the connection stub pipe is formed on the induction conduit section.

* * * * *